US005927907A

United States Patent [19]

Shiraishi

[11] Patent Number: 5,927,907

[45] Date of Patent: Jul. 27, 1999

[54] METHOD AND APPARATUS FOR PREVENTING LIQUEFACTION OF GROUND CAUSED BY VIOLENT EARTHQUAKE

[75] Inventor: Shunta Shiraishi, 4-4, Kinuta 2-chome, Setagaya-ku, Tokyo, Japan

[73] Assignee: Shunta Shiraishi, Tokyo, Japan

[21] Appl. No.: 09/015,295

[22] Filed: Jan. 29, 1998

[30] Foreign Application Priority Data

Apr. 7, 1997 [JP] Japan ..... 9-102434
Jul. 7, 1997 [JP] Japan ..... 9-195204

[51] Int. Cl.[6] ..... E02D 5/18

[52] U.S. Cl. ..... 405/258; 405/128; 405/248; 405/269; 166/401

[58] Field of Search ..... 405/52, 57, 58, 405/128, 129, 248, 258, 269; 166/265, 266, 267, 401

[56] References Cited

U.S. PATENT DOCUMENTS

| | | | |
|---|---|---|---|
| 823,749 | 6/1906 | Wanner | 405/58 X |
| 2,618,475 | 11/1952 | Butler, Jr. | 405/58 |
| 2,772,868 | 12/1956 | Brandt | 405/58 X |
| 2,787,455 | 4/1957 | Knappen | 405/58 |
| 3,638,741 | 2/1972 | Zizak | 405/248 X |
| 4,085,971 | 4/1978 | Jakoby | 166/266 X |
| 4,624,606 | 11/1986 | Nakanishi et al. | 405/269 |
| 5,346,330 | 9/1994 | Bernhardt | 405/128 |
| 5,435,666 | 7/1995 | Hassett et al. | 405/128 |
| 5,588,490 | 12/1996 | Suthersan et al. | 405/128 X |

*Primary Examiner*—Tamara Graysay
*Assistant Examiner*—Jong-Suk Lee
*Attorney, Agent, or Firm*—Jacobson, Price, Holman & Stern, PLLC

[57] ABSTRACT

In order to form an air-mixed zone containing tiny air bubbles in the ground with feeble cohesion or the cohesionless ground, an air-tight cover 1 covering the air-mixed zone is placed on the ground surface, along the outside periphery of the cover 1 an air-tight cut-off wall 2 extending down to the depth of ground water table is installed, the pipes 4 for blowing air are pushed from the ground surface penetrating through the air-tight cover 1 down into the ground, by blowing compressed air from the tip portion of the pipes 4 and collect the blown air through the pipes 5 for collecting air which are spaced at suitable distance from the pipes for blowing air and pushed into the ground in a simultaneous cycle of work with the pipes 4 for blowing air in repeated cycles so that the blown in air circulates and spreads uniformly in the air-mixed zone and splits into tiny air bubbles. The tiny air bubbles stay in the air-mixed zone semipermanently and the degree of saturation of ground water in there is kept at such a low level that any liquefaction due to violent earthquake does not occur even many dozens of years or several centuries after the air-mixed zone is formed by the above-mentioned method which does not induce any such undesirable defect as land subsidence.

4 Claims, 11 Drawing Sheets

METHOD AND APPARATUS FOR PREVENTING LIQUEFACTION OF GROUND CAUSED BY VIOLENT EARTHQUAKE

BACKGROUND OF THE INVENTION

1. Field of the Invention

This invention relates to a method for preventing liquefaction of ground due to violent earthquake and the construction of a pipe for supplying and exhausting air used for the said method. The invention is applicable to very extensive fields of utility. Among those fields of utility to which the invention is particularly applicable is the prevention of severe liquefaction of alluvial ground or of reclaimed land caused by violent earthquake which combined with violent tremor causes such a destructive damage as uneven subsidence of ground surface in large scale, collapse of buildings and/or fall down of bridges, etc.

2. Description of the Prior Art

Liquefaction of ground is a peculiar phenomenon which occurs when a relatively loose sandy ground with feeble cohesion or a cohesionless ground saturated with ground water is shaken violently by earthquake.

This phenomenon can be observed when a volume of loosely packed dry sand in a container decreases when the container is shaken violently because the pore volume of the sand decreases by the shaking down motion.

Likewise phenomenon takes place when a ground of dry loose sand is shaken violently by earthquake, the ground settles down because the pore volume of the sand decreases. In the case when a ground of dry loose sand is shaken, any severe damage may not be caused by it, even though appreciable settlement of ground surface may take place.

However, in the case when the ground of relatively loose sand is saturated with ground water, the tendency of decrease in pore volume due to shaking motion causes a sudden rise of excessively high pore water pressure and contact between sand grains are lost to create a state as though sand grains drift in the ground water. This peculiar phenomenon is called liquefaction. When liquefaction of ground occurs, any obstacle in the ground lighter in unit weight than the ground floats up and anything heavier in unit weight than the ground sinks down. The liquefied ground flows slowly toward a low side even on a slope of very slight gradient which is nearly horizontal. Thus a liquefied ground loses its bearing capacity and the phenomena of pressurized sand blowing up out of the ground takes place leaving small craters at random spots.

The aforementioned liquefaction was presumed to be likely to occur in a sand of relatively uniform grain size up to 2.00 mm in 50% grain diameter D50, the relative density of which is lower than 70%.

However, in Hanshin Awaji Great Earthquake of 1995, liquefaction occurred in the ground of sand and gravel where D50 is much larger than 2.0 mm and grain size are not uniform.

The prior countermeasures for preventing the aforementioned liquefaction are, (1) methods to improve the ground so that liquefaction does not occur even though it is shaken by violent earthquake, (2) methods to design a structure so that it is not damaged fatally even when liquefaction of the ground occurs.

Among the aforementioned countermeasures (1) by improving the property of ground is a method to increase the density of ground, a method to solidify ground, a method to replace the ground with better soil, and a method to lower the degree of saturation of ground water.

The prior method proposed for lowering the degree of saturation of ground water is further divided into the methods to lower ground water level by means of deep wells or by means of drainage tunnels. However, both of those methods involve difficult problems.

By the deep-well method, the ground water is pumped out for lowering the ground water level. This method involves problem of land subsidence due to the consolidation of soft strata caused by the lowering of ground water level and its application to built-up urban areas is impracticable.

By the drainage tunnel method, the ground water is collected into porous tunnels installed at deep depth of ground and the collected water is pumped out for lowering the ground water level. This method also involves the problem of land subsidence due to the consolidation of soft strata caused by the lowering of ground water level and its application to built-up urban areas is impracticable.

As mentioned before, the prior methods proposed to prevent liquefaction by lowering the degree of saturation of ground water involve very difficult problem of land subsidence and their application to built-up urban areas is impracticable.

SUMMARY OF THE INVENTION

A first object of the present invention is to provide a method for preventing seismic liquefaction of ground without causing any land subsidence.

A second object of the present invention is to create an air-mixed zone in the ground with countless tiny air bubbles by blowing compressed air into a ground with feeble cohesion or into a cohesionless ground and to lower the degree of saturation of the ground water in the said air-mixed zone containing tiny air bubbles lower than the level at which liquefaction of ground does not occur at the time of violent earthquake.

A third object of the present invention is to provide a stable ground where the tiny air bubbles is kept semipermanently unless the ground water surrounding the tiny air bubbles does not move.

A fourth object of the present invention is to provide a method for preventing liquefaction which does not require any countermeasure for preventing land subsidence.

A fifth object of the present invention is to provide pipes for supplying and/or exhausting air, the construction of which is most suitable for executing the method of the present invention for preventing liquefaction.

These together with other objects and advantages which will become subsequently apparent reside in the details of construction and operation as more fully hereinafter described and claimed, reference is made to the accompanying drawings forming a part hereof, wherein numerals refer to the parts denoted in the following descriptions.

DETAILED DESCRIPTION OF THE PREFERRED EMBODIMENTS

Figure 1:
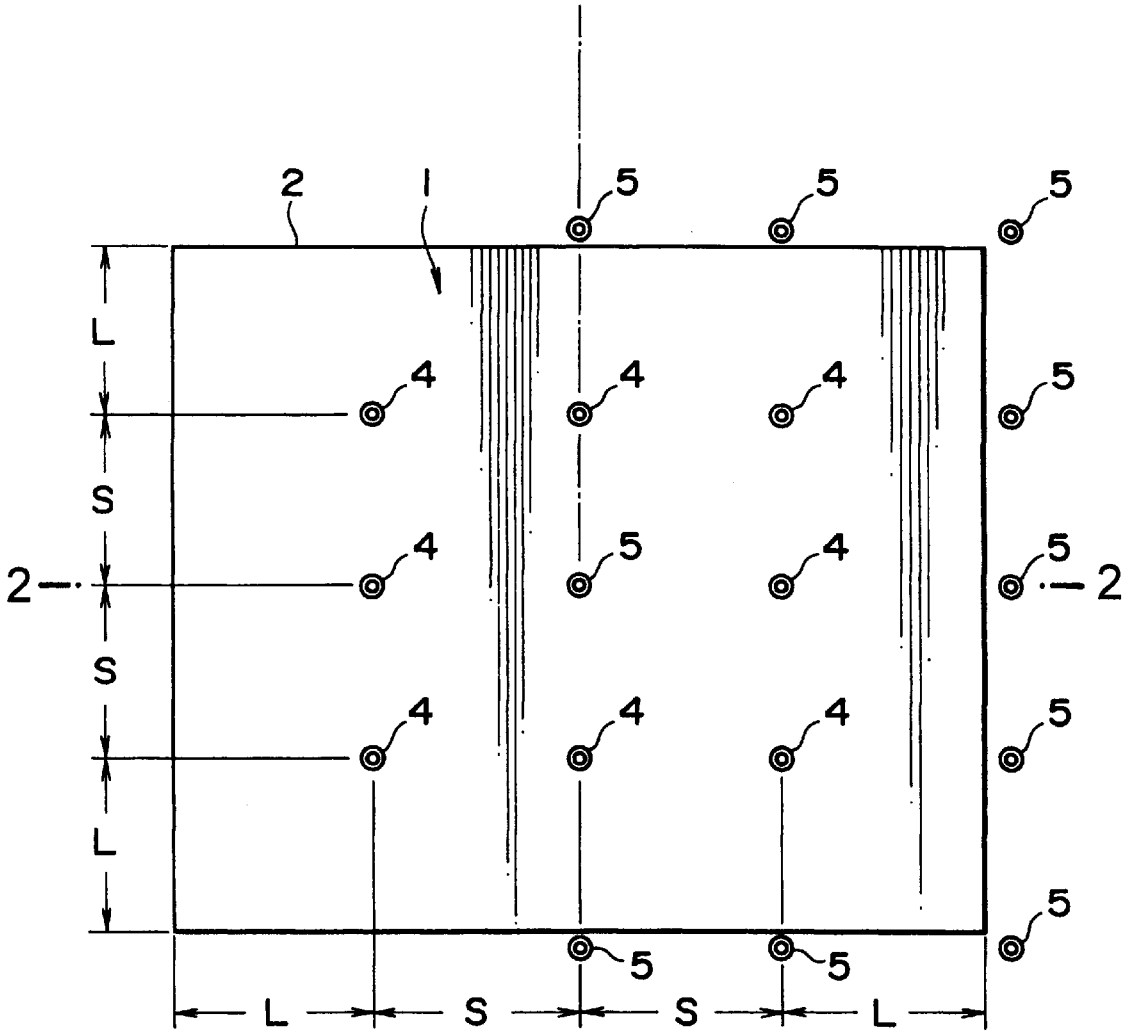
FIG. 1 is a plan of an arrangement of blowing air into ground for executing the method of the present invention for preventing liquefaction.
Figure 2:
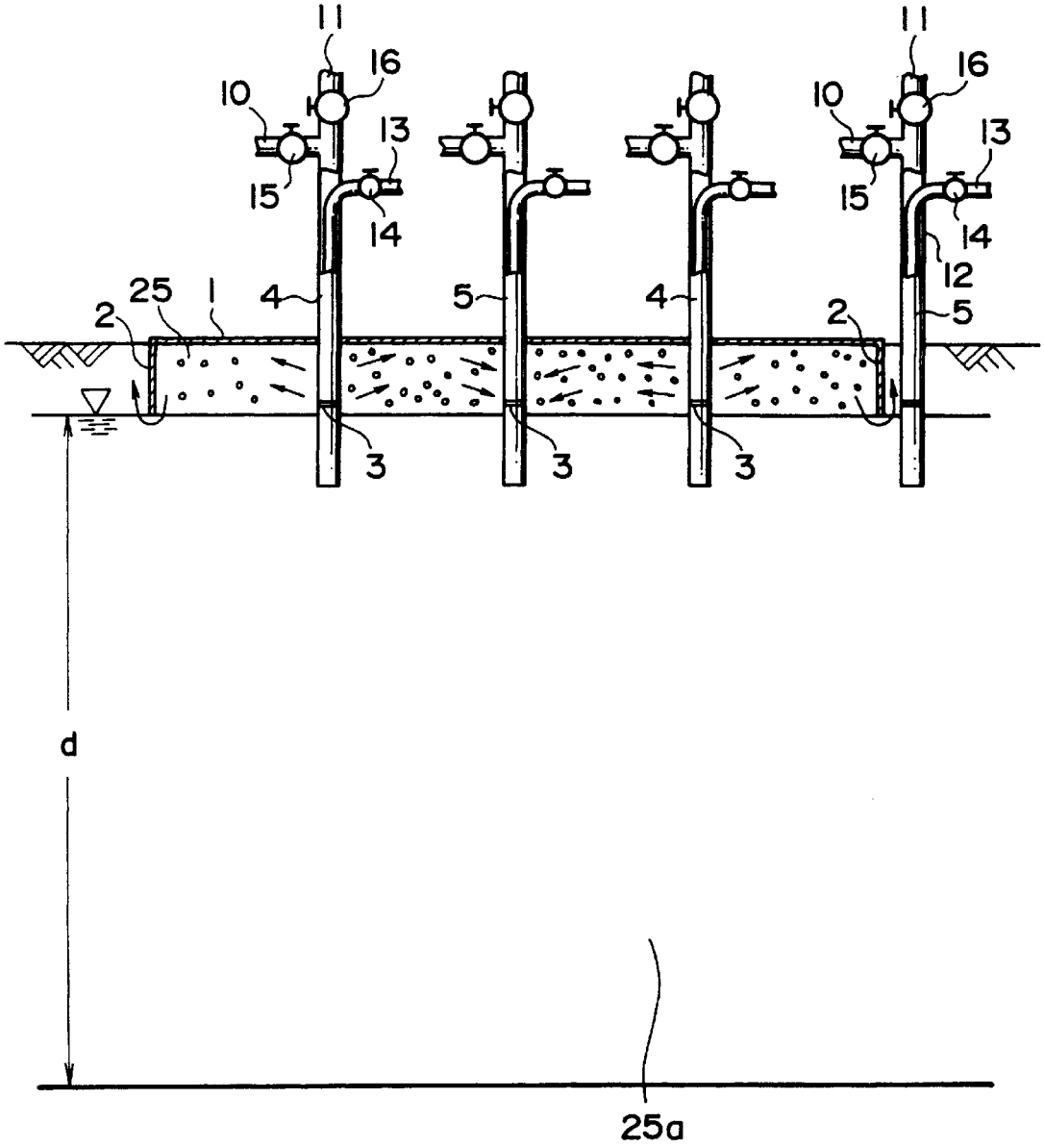
FIG. 2 is a sectional view along section line 2—2 on FIG. 1 showing the first stage of the procedure of blowing air into the ground.
Figure 3:
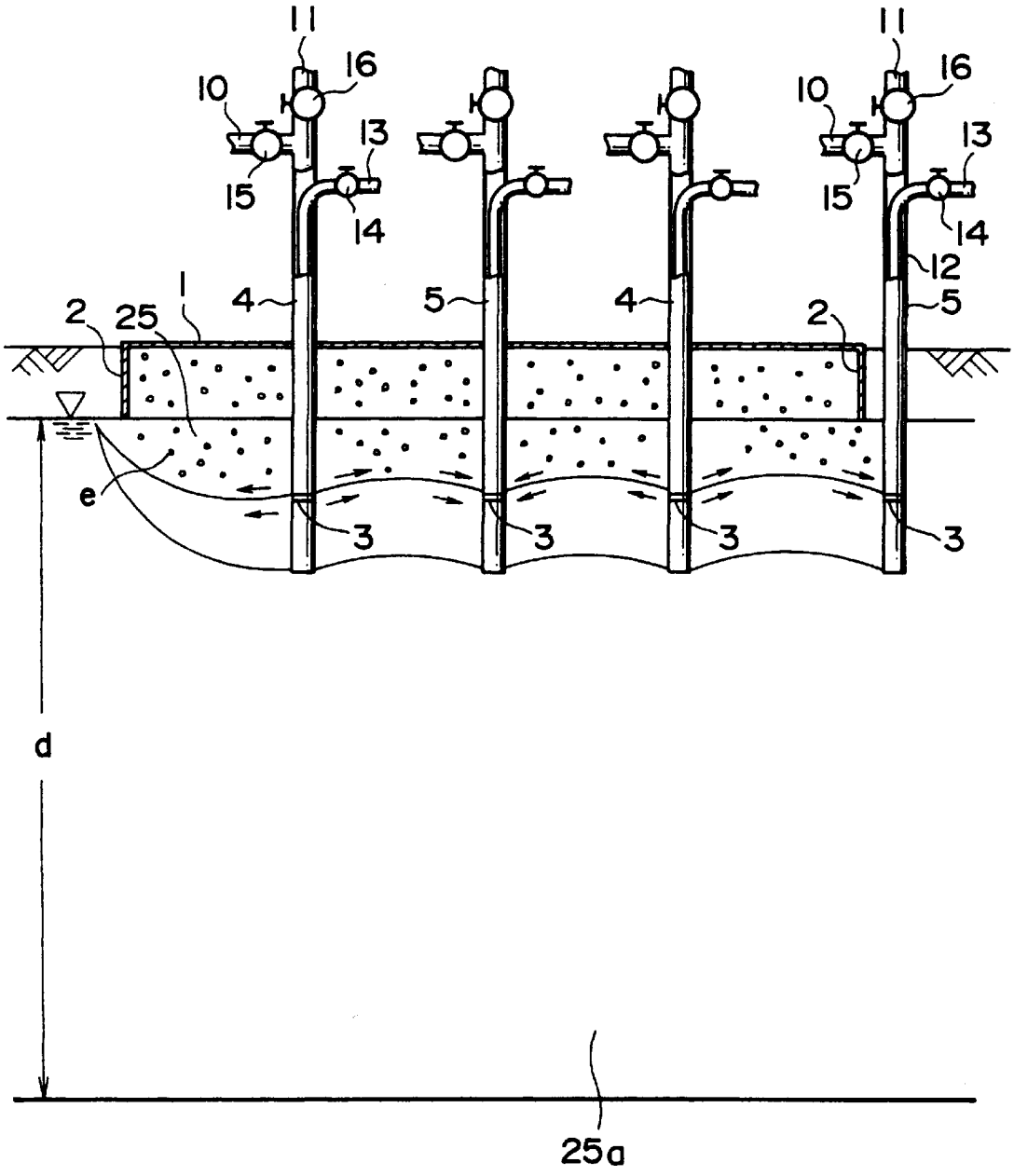
FIG. 3 is a sectional view similar to FIG. 2 showing the second stage of a procedure of blowing air into the ground.
Figure 4:
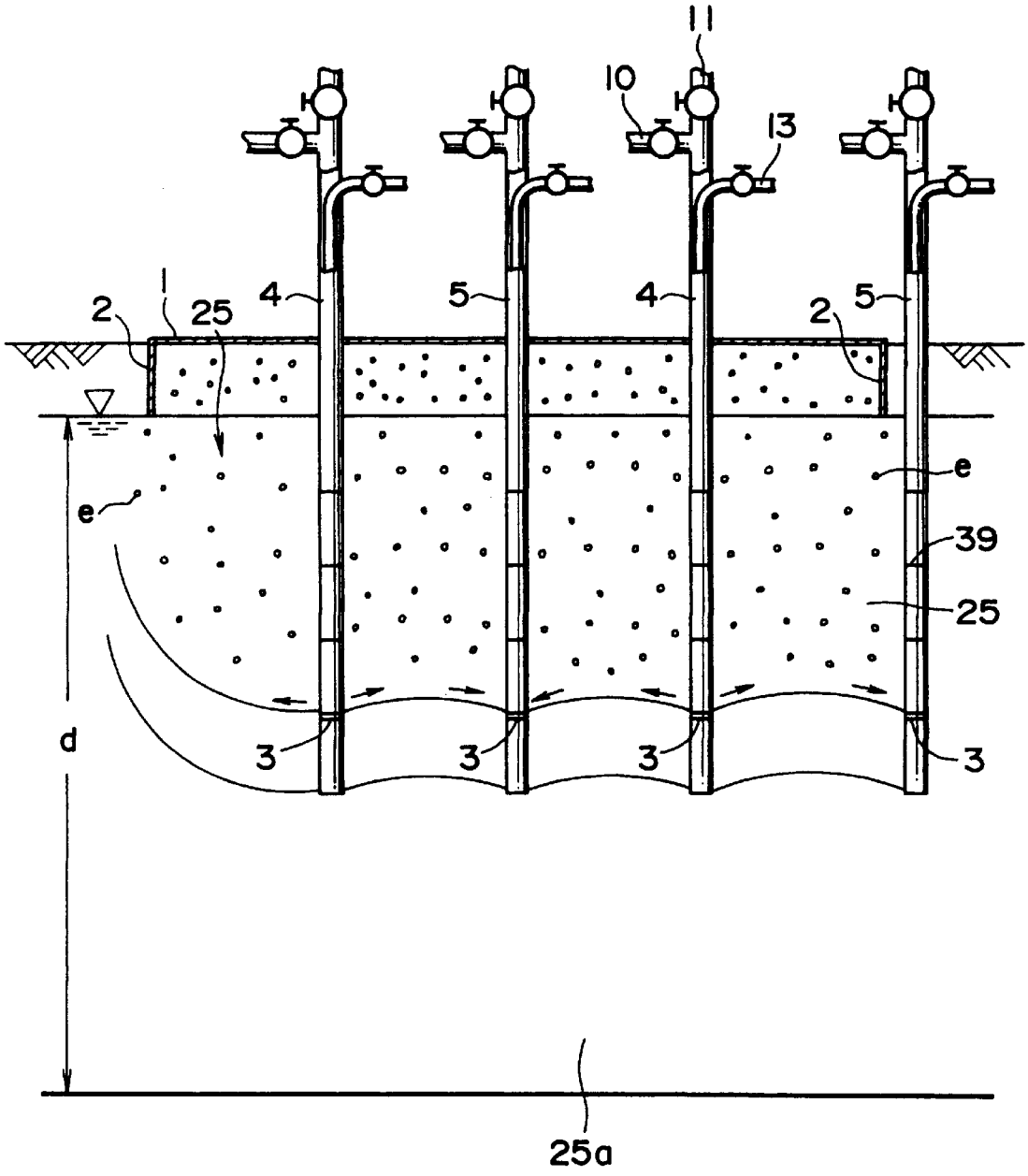
FIG. 4 is a sectional view similar to FIG. 2 showing the third stage of the procedure of blowing air into the ground.
Figure 5:
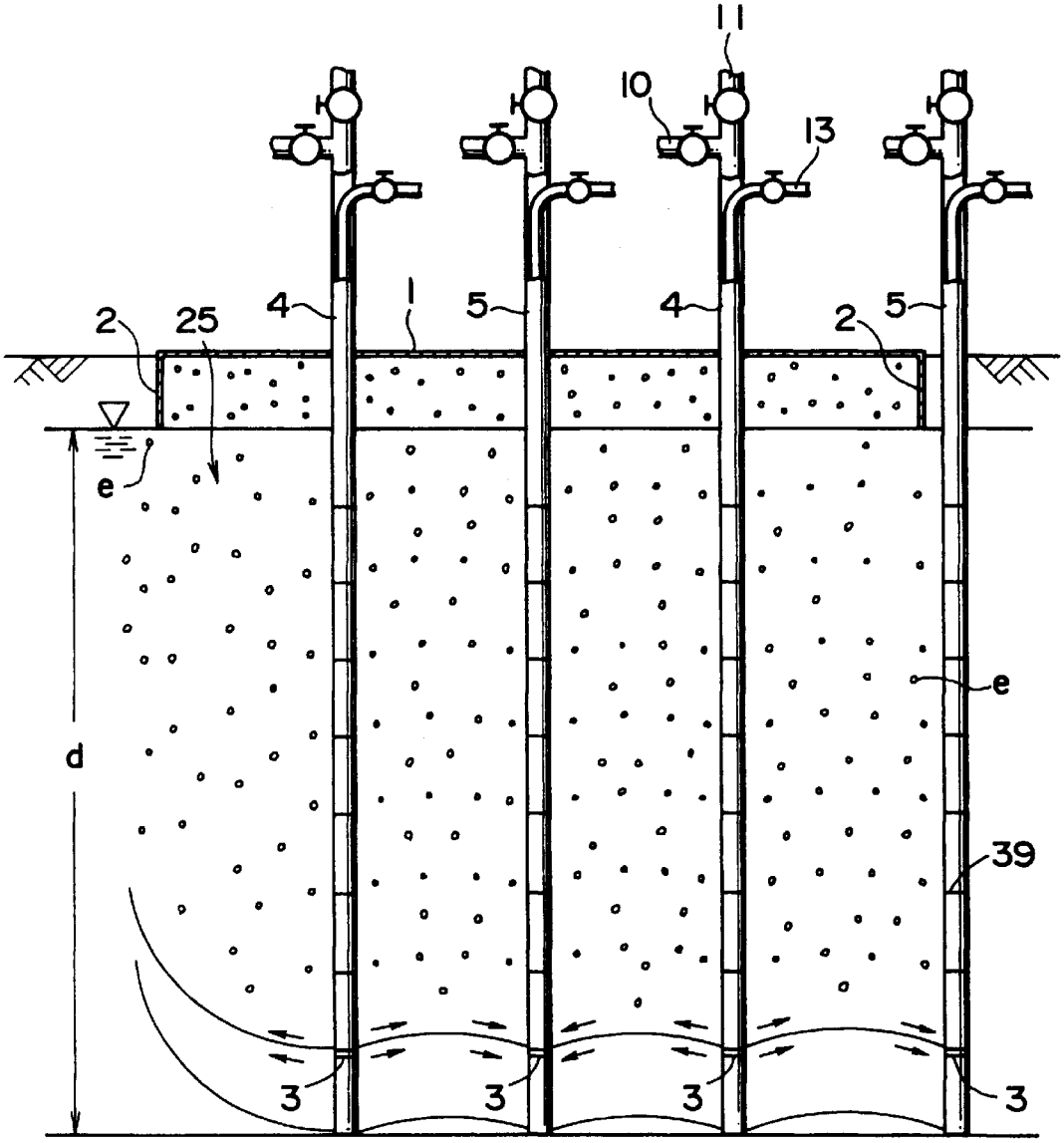
FIG. 5 is a sectional view similar to FIG. 2 showing the last stage of the procedure of blowing air into the ground.

To describe a typical application of the present invention in reference to drawings, at first, an air-tight cover 1 is installed on the ground surface covering the range of ground in which tiny air bubbles e are intended to be mixed in. The periphery of the air-tight cover 1 is enclosed with an air-tight cut-off wall 2 which extends into the ground from the ground surface to the ground water table, as shown in FIG. 1 and FIG. 2. The pipes 4 for blowing air are equipped with fine meshed strainers 3 and are made to penetrate through the said air-tight cover 1 at the middle portion of the range of ground which tiny air bubbles e are intended to be mixed in. The pipes 4 are pushed into an unimproved ground 25*a* to penetrate down for approximately 1 m, and compressed air is fed through the pipes 4 for blowing air which passes through the strainers 3 and is blown into the ground 25 surrounding the pipes 4.

In the range of ground which tiny air bubbles e are intended to be mixed, the pipes 4 for blowing air are laid out symmetrically to the central point where a pipe 5 for collecting air is pushed into the ground and penetrates into the ground for approximately 1 m in a similar way as the pipe 4 for blowing air is pushed into the ground. Through the pipe 5 for collecting air, the air blown in from the pipes 4 for blowing air is collected and exhausted out to the atmosphere above the ground surface.

After the entire space below the said air-tight cover 1 is filled with the air blown in from the pipes 4 and air started to leak out from outside the air-tight cut-off wall 2, the pipes 4 for blowing air and the pipe 5 for collecting air are further pushed into unimproved ground 25*a* to penetrate down for approximately 1 m. Compressed air is blown into the ground surrounding the said pipes 4 for blowing air through the strainer 3. After the entire space below the range of space which is filled with the air blown in at the preceding stage is filled up with the air blown into the ground and air starts to leak out from outside the air-tight cut-off wall 2 and through the pipe 5 for collecting air, the pipe 4 for blowing air and the pipe 5 for collecting air are further pushed down to penetrate into the unimproved ground 25*a* for approximately 1 m. Then repeat the procedure of blowing in air through the pipes 4 and the strainer 3 into the ground surrounding the pipe 4 for blowing air into the unimproved ground 25*a* until the predetermined range of depth which tiny air bubbles e are intended to be mixed in is reached and the predetermined range of depth is filled up with the air thus blown in. In the aforementioned case, short pipes of standard lengths are used for the pipes 4 for blowing air and for the pipe 5 for collecting air, they being spliced together at the level above the ground surface and made to penetrate into the unimproved ground 25*a*.

As shown in FIGS. 2 through FIG. 5, the air blown into the ground by repeating the aforementioned procedure includes a portion of air mass being split into tiny air bubbles e by passing through the fine meshed strainer 3 and the fine gaps between soil grains. An air bubble which is not very small may be deformed into long slender shape and float up through the gaps between soil grains and fills the entire space below the air-tight cover 1 and leaks up from outside the air-tight cut-off wall 2 or through the pipe 5 for collecting air and scatters up out into the atmosphere. However, a tiny air bubble e being entrapped in a cluster of soil grains does not deform to float up through the gaps between soil grains. The air bubble remains semipermanently at the position where it is first entrapped in a cluster of soil grains so long as the ground water surrounding the bubble does not move.

In the case when tiny air bubbles e are intended to be mixed in and spread completely into the entire space of the depth range d (as shown in FIGS. 2 through FIG. 5), the pipes 5 for collecting air are laid out along the periphery outside the cut-off wall 2 at the spacing approximately equal to the spacing s between the pipes 4 for blowing air as shown on the right side half of FIGS. 2 through FIG. 5. The pipes 5 for collecting air are pushed down to penetrate into the ground for about 1 m in a way similar to the pipes 4 for blowing air. The pipe 5 for collecting air installed at the central position are pushed down in a way similar to the other pipes being pushed down with all pipes pushed down altogether in a cycle of work.

Meanwhile, in FIG. 1 the pipes 5 for collecting air are shown on the right side half and may be laid out in similar layout on the left side half. Nevertheless, it may be possible to omit the pipes 5 for collecting air outside the cut-off wall 2.

By the aforementioned procedure, an air-mixed zone containing tiny air bubbles e, in which the degree of saturation of ground water is low, is formed by blowing compressed air into the ground with feeble cohesion or the cohesionless ground, so long as the ground water in the zone does not flow. The degree of saturation of the ground water in the zone is kept semipermanently at the level lower than the limit at which liquefaction of the air-mixed zone does not occur at the time of violent earthquake.

The spacing s between the pipes 4 for blowing air, the distance L from the pipes 4 to the periphery of the air-tight cover 1 and the distance m from the pipes 4 for blowing air to the pipe 5 for collecting air may be determined taking the thickness d of the soil strata in which the air-mixed zone with countless tiny air bubbles e is intended to be formed and the grain-size distribution, density and other properties of the said soil strata into account.

The place where the air-blowing in treatment of the present invention is required is located on a flat alluvial ground in urban areas or on a reclaimed land in water front areas facing the sea or a wide river where water supply and sewer systems are completely provided and no shallow well is utilized. Even if there are shallow wells in urban areas, they are not utilized daily. Therefore, the ground water in the place at shallow depth normally does not flow.

When the method of the present invention is to be applied to the ground of a river bed or of the sea bottom, the gradient of the water bottom surface is so slight that it is nearly horizontal, the ground water flow in the water bottom ground is extremely slow.

The fact that the ground water flow in a river bed ground is extremely slow and tiny air bubbles in the river bed did scarcely move is verified by observing the state of Bandai Bridge after the Niigata Earthquake in 1964 and of Kanzaki River Bridge after the Hanshin Awaji Great Earthquake in 1995, the air-mixed zones with tiny air bubbles around the pneumatic caisson foundations which was formed while the caissons were built and sunk into the ground remained scarcely moved for 35 years at Bandai Bridge and 27 years at Kanzaki River Bridge, respectively, after their caissons were built and in the air-mixed zones liquefaction of the ground was prevented and both bridges survived the violent earthquakes without any damage beyond repair while many other bridges in the violent earthquake zone founded on such types of foundation as piles or open caissons collapsed or were heavily damaged beyond repair. In other words, the present invention is conceived from the results of observations of the air-mixed zones formed by the compressed air leaked out of the pneumatic caissons and the air-mixed zones containing countless tiny air bubbles scarcely moved and remained nearly at the position where the tiny air bubbles are first entrapped in the clusters of soil grains.

It was verified also by the theory of hydrology that a tiny air bubble stays semipermanently at the position it is first entrapped in a cluster of soil grains so long as the ground water surrounding the air bubble does not move.

In the following, the executing procedures are described further in turn of enforcement.

Figure 6:
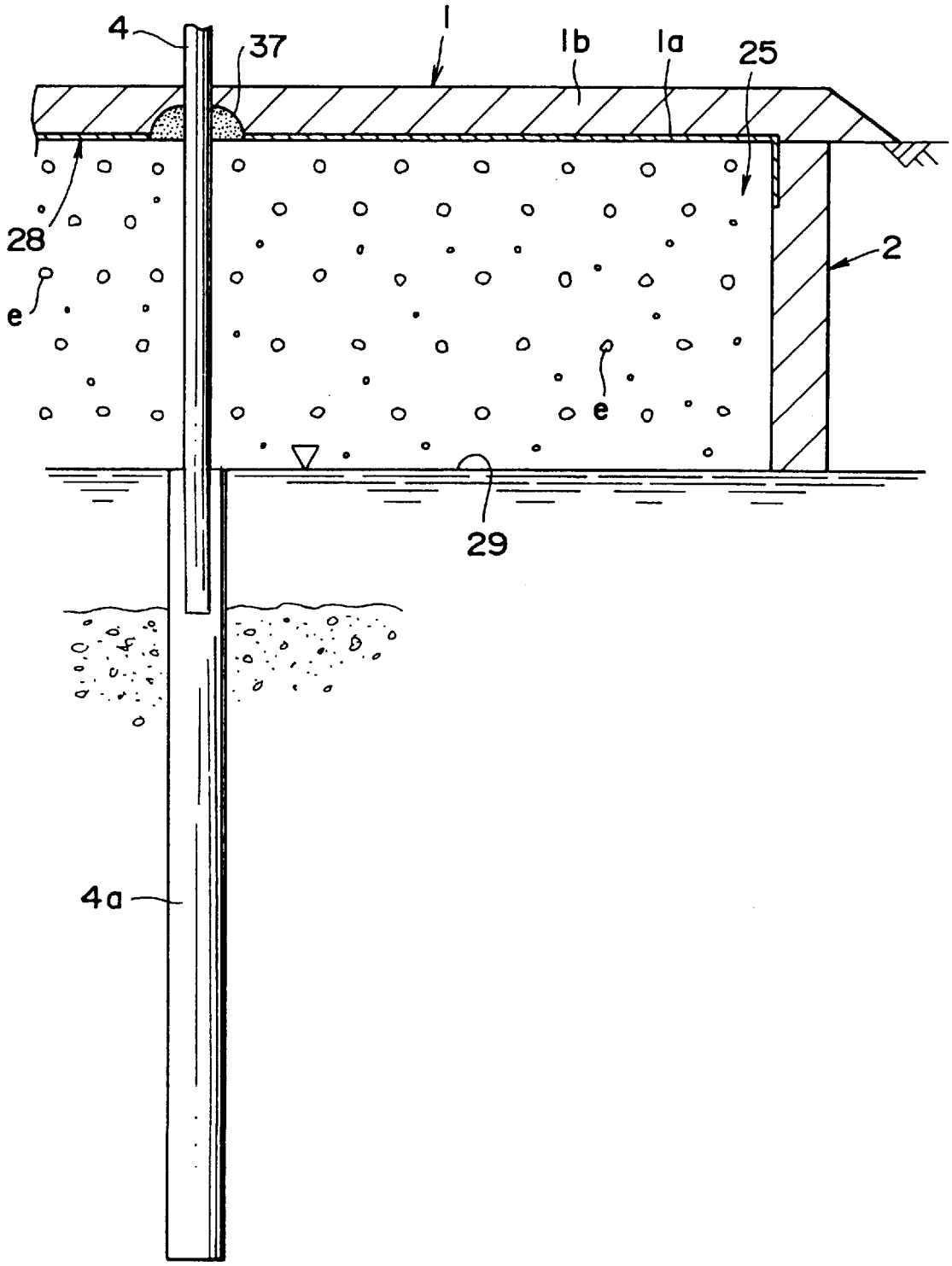
FIG. 6 is a cross section of an air-tight cover for preventing leakage of the air blown into the ground.

The air-tight cover 1 to be placed on the ground surface on land is composed of such an air-tight sheet as vinyl chloride sheet laid on the ground surface 28. The periphery of the cover 1 is fixed down at many points by means of pegs or stone weights and a soil cover 1*b* of suitable thickness is placed over it as shown in FIG. 6. When an air-tight cover like asphalt pavement exists, the existing cover may be utilized in place of the cover 1. The gaps between the cover 1 and the pipes 4 for blowing air, the pipe 5 for collecting air as well as the cut-off wall 2 are to be sealed with such a flexible material 37 as a rubber membrane or a lump of plastic clay paste so that the leakage of air through the gaps is minimized.

The pipes 4 for blowing air and the pipe 5 for collecting air may be composed separately from each other. However, in a practical example shown in FIG. 7, an air supply pipe 10 equipped with an air supply valve 15 connected to a supplying source of compressed air and an exhaust pipe 11 equipped with an exhaust valve 16 are combined together to form an air supply-exhaust pipe 12. The pipe 12 may be used both as the pipe 4 for blowing air and the pipe 5 for collecting air. Further, in the tip end portion of the air supply-exhaust pipe 12 a water supply pipe 13 equipped with a supply water valve 14 connected to a source of supplying high pressure water which is led into the air supply-exhaust pipe 12 to form a double tube containing the water supply pipe 13 inside. The water supply pipe 13 is connected to the first tube body 17 equipped with a ring nozzle 8 for jetting water and to the cutter blade 19 for drilling down the air supply-exhaust pipe 12 into the ground. The air supply-exhaust pipe 12 is connected to the second tube body 18 and to the first tube body 17 detachably with screw couplings 41. The second tube body 18 equipped with the strainer 3 through which air is blown out or collected in.

The first tube body 17 includes ring nozzle 8 for jetting water with water inlet holes 7 letting the water jetted out of the ring nozzle 8 into the first tube body 17. The ring nozzle 8 for jetting water is so designed to jet water in a ring shape and is composed of a block 20, the form of which is nearly conical and fixed from inside to the first tube body 17, forming a narrow ring shaped slit inside the first tube body 17. On top of the tube body 17, a ring valve 6 is provided which is normally closed by fitting down into a ring groove 6*a* by its own weight or by pull-down springs 6*b* (not shown), but is activated to open by the upward pressure of the water being let in through the inlet holes 7 for letting in the water jetted out and drained up through the exhaust pipe 11.

Figure 8:
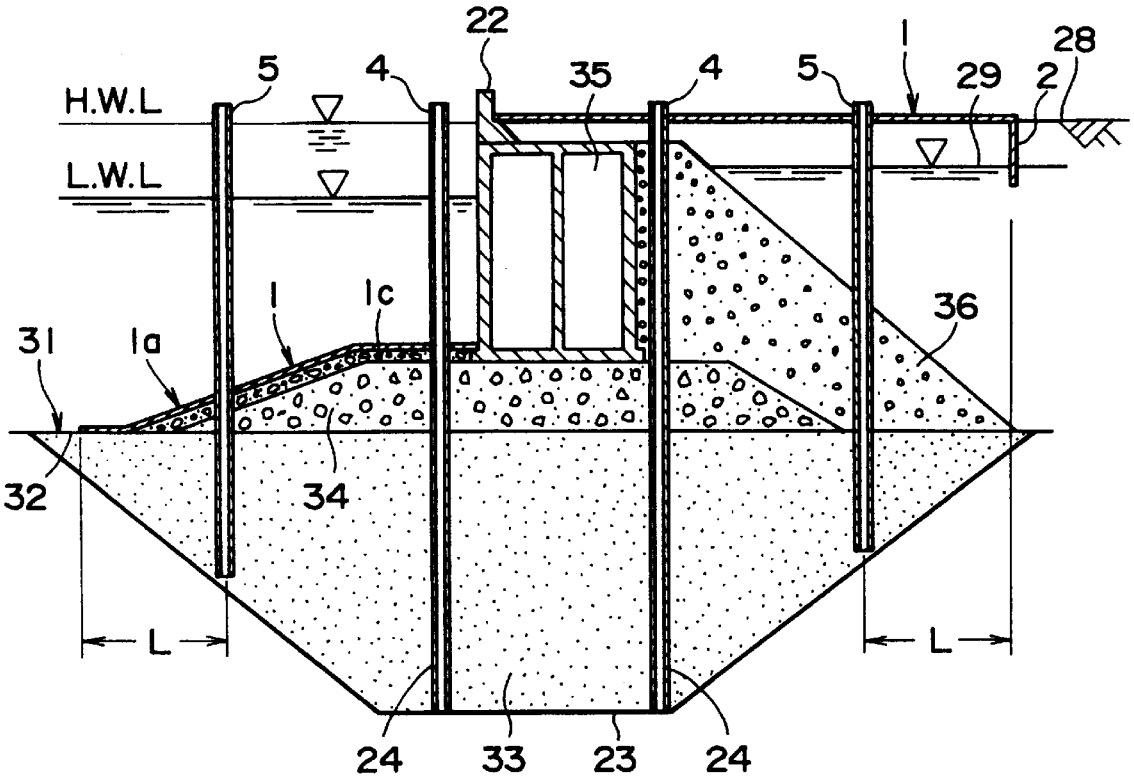
FIG. 8 is a cross section illustrating execution of blowing air into the backfill and the foundation of a quay wall.

As shown in FIG. 8, the air-tight cover 1 to be placed on the ground surface 32 of water bottom 31 may be formed with such an air-tight sheet 1*a* as vinyl chloride sheet and fixed down with a number of weights 1*c* of stones or soil packed bags and the like so as not to be dislocated by waves or water current. The gaps between the cover 1 and the pipes 4 for blowing air as well as the pipes 5 for collecting air are to be sealed with such a flexible material 37 as a rubber membrane so that the leakage of air through the gaps is minimized.

The cut-off wall 2 which extends from the ground surface 28 down to the ground water table 29 is formed by filling a narrow trench with such an air-tight material as clay or by installing small-size sheet piles for trenches. The sheet piles may be pulled out for reuse after the procedure of blowing air into the ground is finished.

The installation of the cut-off wall 2 along the periphery of the air-tight cover 1 to be placed on the water bottom as shown in FIG. 8 is not required. In FIG. 8, a box caisson for quay wall 35 is placed on the stone mound 34 underlain with the replaced sand 33 and the stone backfill 36 is placed on the back side of the quay wall 35.

Figure 7:
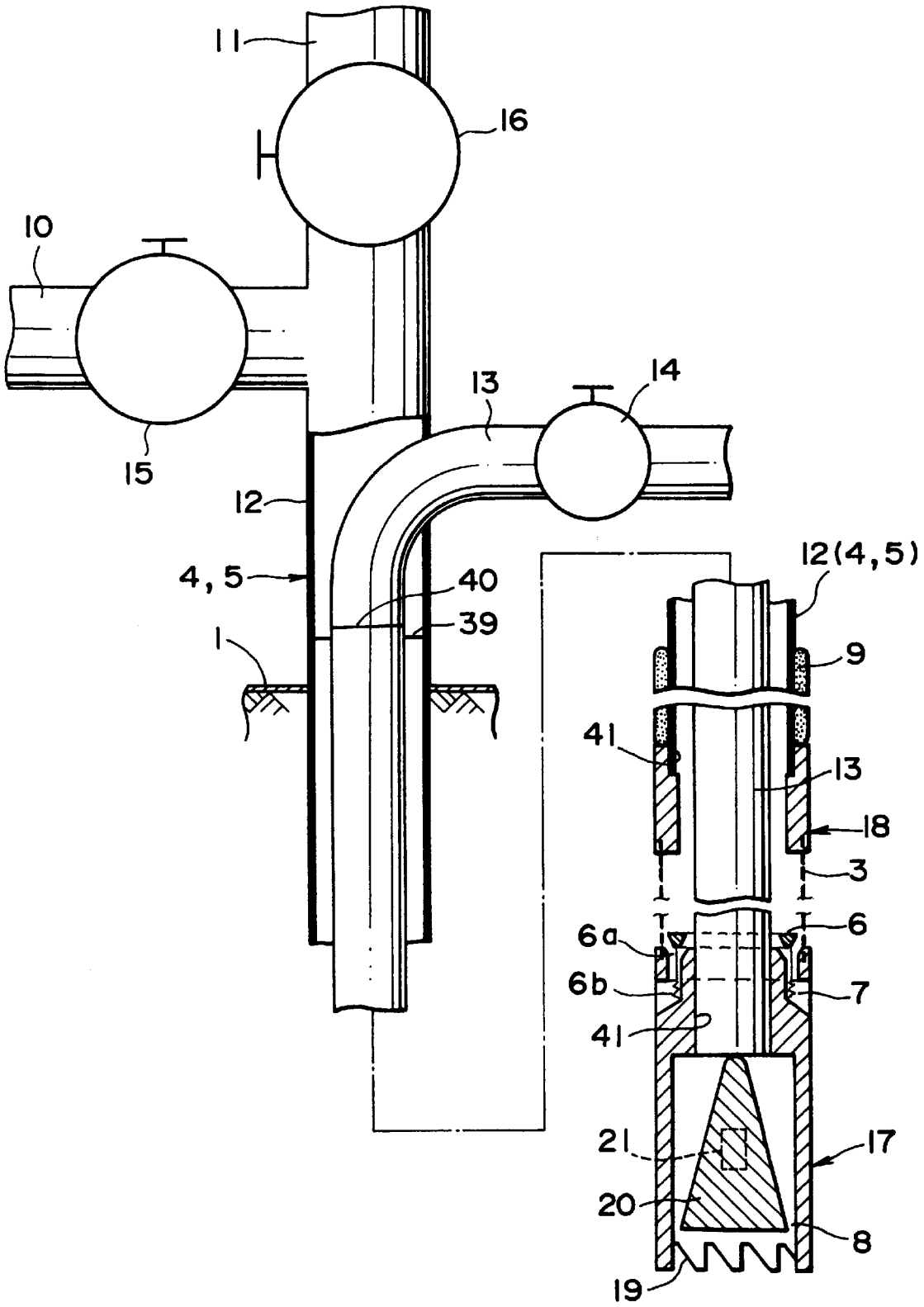
FIG. 7 is a cross section illustrating the construction of a pipe for creating an air-mixed zone with countless tiny air bubbles in the ground.

For making the air supply-exhaust pipe 12 and the strainer 3 penetrate into the unimproved ground 25, open the water supply valve 14 of the water supply pipe 13 which is inserted into the air supply-exhaust pipe 12 in which the pipe 4 for blowing air equipped with the air supply valve 15 and the exhaust pipe 11 equipped with the exhaust valve 16 are combined to form a double tube as shown in FIG. 7 schematically, close the air supply valve 15 and open the air exhaust valve 16. Then the highly pressurized water is jetted out through the ring nozzle 8 in the first tube body 17 to loosen the ground below the tip end of the air supply-exhaust pipe 12 and the pipe 12 is pushed into the ground while it is turned back and forth.

The water jetted out is let in through the water inlet holes 7 provided at the top portion of the first tube body 17, made to flow up through the annular space in the air supply-exhaust pipe 12 inside the strainer 3, pass through the exhaust valve 16 and ejected up out through the exhaust air pipe 11. For blowing air into the ground, close the exhaust air valve 16, open the supply air valve to feed compressed air to blow air out through the strainer 3 of the second tube body 18 into the ground 25 surrounding the strainer 3.

The conically shaped block 20 which forms the central block of the ring shaped nozzle 8 for jetting pressurized water is fixed to the first tube body 17 at more than three points with supporting arms 21.

In the gap between the portion of the tube body above the strainer 3 of the second tube body 18 of the air supply-exhaust pipe 12 and the ground, an expandable seal 9 is inserted. This expandable seal 9 is inflated by the compressed air supplied through the supply air pipe 10 to close the gap between the second tube body 18 and the ground so as to prevent the air blown out through the strainer 3 from leaking through the gap between the second tube body 18 and the ground to flow upward above the ground water surface and to scatter out.

The air supply-exhaust pipe 12 which is pushed down to penetrate into the ground as the pipe 4 for blowing air may be converted to the pipe 5 for collecting air by closing the air supply valve 15 and the water supply valve 14 and by opening the exhaust air valve 16. The air thus collected through the stainer 3 is exhausted above the ground surface through the exhaust air valve 16 and the exhaust pipe 11.

Because the air exhaust passage of the air supply-exhaust pipe 12 which is made to penetrate into the ground is filled with water, the rate of ejecting the air is low. However, when the suction end of a water pump is connected to the exhaust pipe 11 for pumping out the water, the rate of ejecting the air may be raised.

Where the penetration resistance of ground of pebble or sand and gravel is so heavy that it is not able to push the pipe 4 for blowing air, the pipe 5 for collecting air or the air supply-exhaust pipe 12 is inserted into the ground with the aide of highly pressurized water jet only, the aforementioned pipe 4 for blowing air or the air supply-exhaust pipe 12 may be inserted through the small hole 4*a* as shown in FIG. 6 bored by such means as rotary boring for subsurface exploration and pushed further into the sandy ground.

For pulling out the pipe 4 for blowing air or the pipe 5 for collecting air after the air blowing-in treatment is finished, such a set-up as a tripod stand for soil boring may be utilized. Meanwhile, the pipe 4 for blowing air or the pipe 5 for collecting air and/or the air supply-exhaust pipe 12 as well as the water supply pipe 13 is composed of a number of short pipes of standard lengths which are spliced together above the ground surface with screw joints 39 and 40 as shown in FIG. 7 and pushed down into the ground.

For supplying the highly pressurized water, a high pressure water pump (not shown) connected to the water supply pipe 13 may be used.

For supplying the compressed air for blowing into the ground, a reciprocal air compressor with maximum outlet pressure of 4 times the atmospheric pressure equipped with a receiver tank and connected to the air supply pipe 10 through an automatic pressure regulator (not shown) and compressed air at a suitable pressure may be supplied.

Although the air blown into the ground through the pipe 4 for blowing air and the strainer 3 may intrude into the pore space between soil grains while pushing forward the ground water ahead of it, it does not spread uniformly but branches off into plural bands. The state of the intrusion of air into the ground is similar to the split-in intrusion of grouted chemical solution for solidifying soil.

When the air at low pressure spreads uniformly into the ground forcing the ground water ahead of it, the forwarding velocity of the air front is equal to the seepage velocity of ground water through the porous media of the ground. Even in coarse sand the forwarding velocity of the air front is extremely low in the order of several millimeters a minute, and a very long time in the order of dozens of hours is required for the air front to travel the distance of several meters from the strainer 3 of the said pipe 4 to the outside periphery of the air-mixed zone where tiny air bubbles are intended to be mixed in or to the pipe 5 for collecting air laid out along the periphery of the air-mixed zone and the efficiency of air-blowing in process using the air at low pressure is extremely low. In order to facilitate the air-blowing in process air pressure may be raised to such a suitable level as to make the air branch off into bands in a way similar to the split-in intrusion of grouted chemical solution and the air front may travel at high velocity to reach the outside periphery of the space in which air is intended to be mixed in several dozens of minutes.

For instance, the air blowing in work is performed dividing the depth of 10 m into ten layers, consuming 30 minutes a layer, then the entire work may be completed in 5 hours.

When the ground in which an air-mixed zone containing countless tiny air bubbles is intended to be formed by blowing compressed air into it contains ferric oxide, there is a danger of occurrence of oxygen-short air. It requires considerable time and expense to examine the existence of ferric oxide in the said ground by chemical analysis. Therefore, in all cases without exception, the oxygen content of the air exhausted out of the pipe 5 for collecting air is measured every time after each cycle of air blowing in work is finished and if the oxygen content is less than 21%, air blowing in work should be continued to circulate air through the ground until the oxygen content recovers the normal level of 21%.

Figure 9:
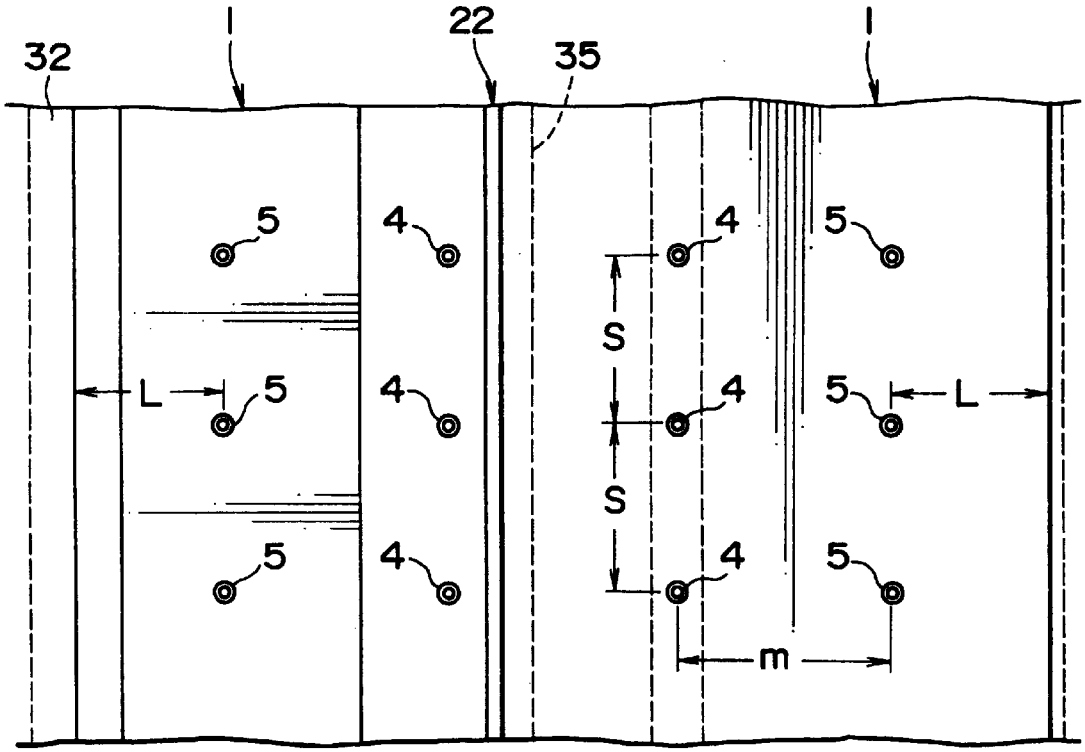
FIG. 9 is a plan illustrating what is shown in FIG. 8.

Preventive measures against liquefaction of the backfill and the foundation ground of a quay wall caused by violent earthquake is shown in FIG. 8 and FIG. 9, in which an air-tight cover 1 is placed on the surface of the backfilled ground 22 of a quay wall. At the outside periphery of the cover 1, a cut-off wall 2 extending from the ground surface down to the ground water table is installed and another air-tight cover 1 is placed on the water bottom surface 31 in front of the quay wall 22.

The pipe 4 for blowing air and the pipe 5 for collecting air are installed at the position close to the back face and the front end of the quay wall 22 as shown in FIG. 8 and FIG. 9. All of the pipes 4 for blowing air and the pipes 5 for collecting air are made to penetrate pointing into the deep portion of the replaced sand 23. All pipes are to be pushed in altogether in a cycle of work, repeating the procedures as mentioned previously, air is blown into the ground in layers.

The spacing s between the pipes 4 for blowing air, the distance m from the pipes 4 for blowing air to the pipes 5 for collecting air as well as the distance L from the pipes 5 for collecting air to the outside periphery of the air-tight cover 1 as shown in FIG. 9 are determined taking the thickness d of the cohesionless soil strata or the soil with feeble cohesion, the grain size distribution, the density and other physical properties of the said soil strata into account.

For making the pipe 4 for blowing air or the pipe 5 for collecting air penetrate through the backfill stone 36 and the stone foundation course 34, a large size hole 24 is bored beforehand by such means as rotary boring, sand is filled inside the casing of the bored hole 24 and by pulling out the casing and adding sand as the casing is pulled out so as to form a sand column 24. The pipe 4 for blowing air or the pipe 5 for collecting air is made to penetrate into the sand column 24 with the aide of water jetting.

The spacing s between the pipes 4 for blowing air, the distance m from the pipes 4 for blowing air to the pipes 5 for collecting air and the distance L from the pipes 5 for collecting air to the outside periphery of the air-tight cover 1 may be determined by taking the thickness d of the strata in which tiny air bubbles are intended to be mixed in, the grain-size distribution, density and other physical properties of said strata into account.

The oxygen content of the air blown in from the pipes 4 for blowing air and exhausted out from the pipes 5 for collecting air should be measured at the end of every cycle of air blowing in work in order to ascertain the existence of oxygen-short air. In any case, when the danger of oxygen-short air occurs, the air blowing in work should be continued to circulate air through the ground until the oxygen content is recovered to the normal level of 21%.

When air blowing in work into the deepest portion of the replaced sand below the foundation of the quay wall is completed, the degree of saturation of the ground water in the backfill ground or in the replaced sand 33 of the quay wall 22 is kept semipermanently at the level sufficiently low for preventing occurrence of liquefaction and the quay wall does not collapse due to liquefaction of ground at the time of violent earthquake.

Figure 10:
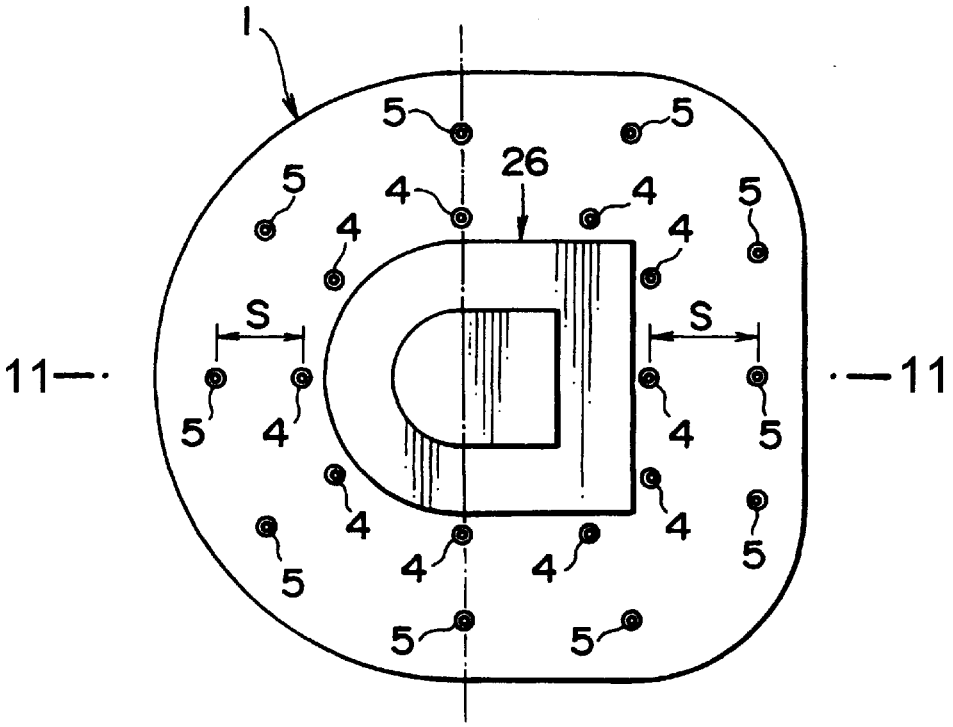
FIG. 10 is a plan illustrating execution of blowing air into the ground around a foundation body.
Figure 11:
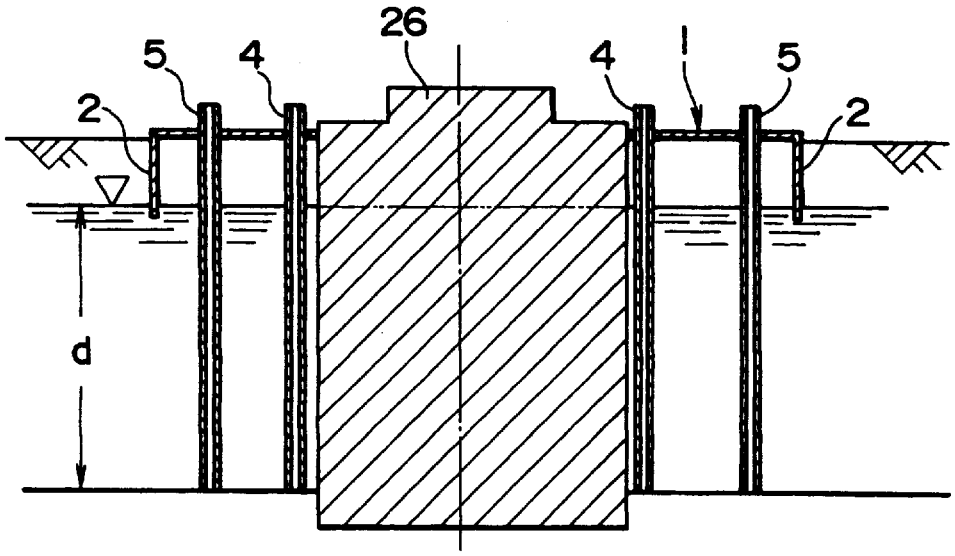
FIG. 11 is a sectional view along section line 11—11 on FIG. 10.

The preventive method against liquefaction of the ground supporting direct foundation, pile foundation and/or open caisson due to an earthquake includes the air-tight cover 1 which encloses air tightly the foundation body 26 being placed on the ground surface around the foundation body 26. Along the outside periphery of the air-tight cover 1, a cut-off wall extending from the ground surface down to the depth of the ground water table is installed as shown in FIG. 10 and FIG. 11. As shown in the left half plan of each drawing, the outside periphery of the air-tight cover 1 is made circular when the foundation body 26 is circular and as shown in the right half plan of each drawing, the outside periphery of he air-tight cover 1 is made rectangular when the foundation body 26 is rectangular.

A number of pipes 4 for blowing air are laid out on a concentric circle close to the outside periphery of the foundation body. The spacing s between the pipes 4 for blowing air is determined taking the thickness d of the cohesionless soil strata or with feeble cohesion, the gain size distribution, the density and other physical properties of the said strata into account.

In air blowing in treatment, all the pipes 4 for blowing air and the pipes 5 for collecting air are made to penetrate down for a certain length altogether in a cycle of work, by repeating the said cycles of work, compressed air is blown into the ground by layers in similar way as described before on the treatment on the ground surface.

Figure 12:
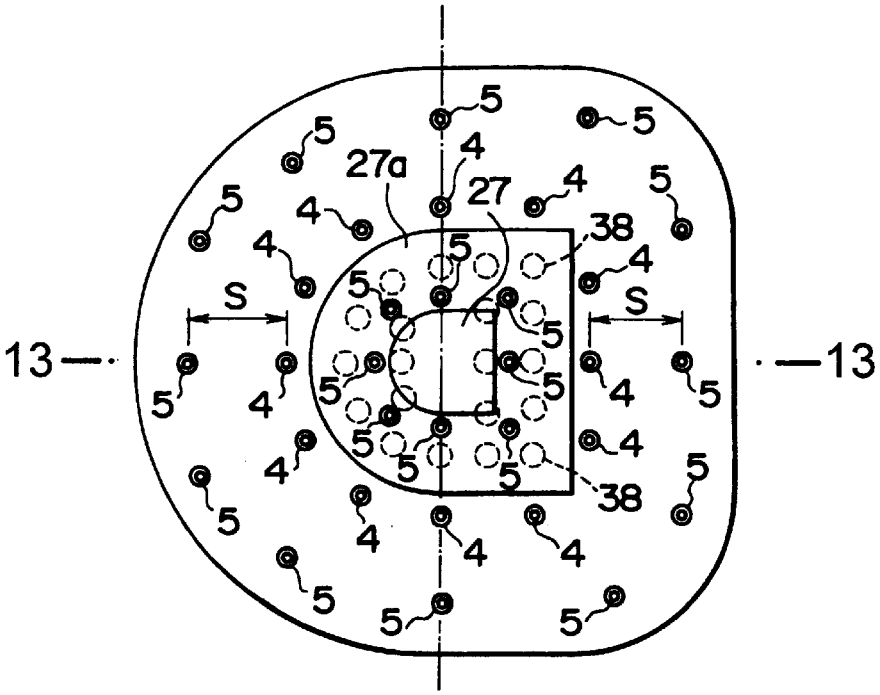
FIG. 12 is a plan illustrating execution of blowing air into the ground around and between piles of a pile foundation.
Figure 13:
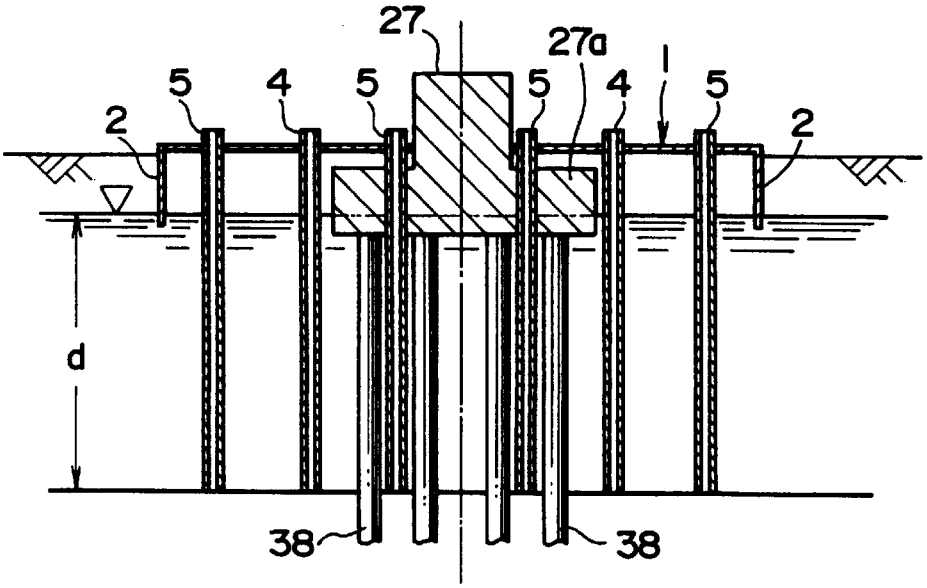
FIG. 13 is a sectional view along section line 13—13 on FIG. 12.

In the case of pile foundation as shown in FIG. 12 and FIG. 13, not only the ground around the pile group but also the ground between piles 38 is treated by blown in air. As shown in each drawing, holes are bored through the pile cap footing 27*a* and the pipes 5 for collecting air about half in number of the pipes 4 for blowing air laid out around the footing 27*a* are installed to make the air blown in below the footing 27*a* flow toward the pipes 5 for collecting air and exhausted out through the pipes 5 for collecting air up above the ground surface.

In all cases of direct foundation, open caisson foundation and pile foundation, the oxygen content of the air exhausted out from the pipes 5 for collecting air is measured to ascertain any presence of oxygen-short air every time after one cycle of air blowing in work is finished. In any event, if there is any danger of occurrence of oxygen-short air, the air blowing in work should be continued to circulate air through the ground until the oxygen content is recovered to the normal level of 21%.

The air-tight cover to be placed under water on the water bottom surface is placed according to the manner mentioned previously in the description related to the quay wall. After the air blowing in treatment is applied by the aforementioned procedures covering the entire depth range of the cohesionless ground or the ground with feeble cohesion, the degree of saturation of the ground water in the said ground is kept semipermanently at such a sufficiently low level as the liquefaction of the ground caused by violent earthquake is prevented and the structure supported on said foundation in said ground neither collapses nor tilts even though it is shaken violently.

As described before, the following are peculiar features of the present invention.

That is, the method for preventing liquefaction related to the present invention is featured in that, in order to form an air-mixed zone containing tiny air bubbles in the ground with feeble cohesion or the cohesionless ground by blowing compressed air into the ground for lowering the degree of saturation of ground water in the said zone where tiny air bubbles are to be mixed in down to such a level as liquefaction of the zone of ground does not occur at the time of violent earthquake.

The method for preventing liquefaction caused by earthquake of the present invention is featured in that, in order to form an air-mixed zone containing tiny air bubbles in the ground with feeble cohesion or the cohesionless ground, an air-tight cover on the ground surface is placed and at the same time a cut-off wall extending down to the depth of ground water table along the outside periphery of the air-tight cover is made, pipes for blowing air are made to penetrate through the air-tight cover inside the cut-off wall into the ground, compressed air is blown out from the tip portion of the pipe to fill the pore space of the ground below the air-tight cover until the pore space below the air-tight cover is filled up with air and after the air leaks out from the outside the cut-off wall, the air is collected into the pipes for collecting air which are penetrated into the ground together with the pipes for blowing air are made to penetrate into the ground, the air collected is exhausted out above the ground surface, the pipes for blowing air and the pipes for collecting air are further made to penetrate more deeply into the ground, the process of blowing compressed air and collecting air is repeated until the improvement of ground is made down to the predetermined depth.

Furthermore, the construction of the air supply-exhaust pipe to be used for the method of preventing liquefaction of the ground at the time of earthquake related to the present invention is featured in that the air supply pipe equipped with an air supply valve and connected to an air supply source and the air exhaust pipe equipped with an air exhaust valve connected to an air exhaust pipe are combined together to form an air supply-exhaust pipe which may be used both for blowing air and collecting air, a water supply pipe equipped with a water supply valve connected to a high pressure water supply source is inserted inside the air supply-exhaust pipe to form a double tube. The water supply pipe is connected to the first tube body provided with cutter blades for drilling ground and containing a set of jet water nozzle being the air supply-exhaust pipe connected detachably to the first tube body and further connected to the second tube body equipped with a strainer for blowing or collecting air.

In the first tube body, in addition to the ring nozzle for jetting water, inlet holes are provided for recovering the water jetted out of the jet nozzle.

Furthermore, the jet water nozzle related to the present invention is featured by that, for jetting water in a ring shape, a conical guide block which is held inside the first tube body with a ring-shaped slit between the former and the latter and that, in the first tube body, a ring valve, which being normally closed by fitting down into a ring groove by its own weight or by the pull down forces of springs, is activated to open the upward pressure of the water let in through the inlet holes, is provided.

Therefore, the following effect may be achieved.

That is, because, by utilizing the method for preventing liquefaction of ground at the time of violent earthquake, an air-mixed zone containing countless tiny air bubbles is formed by blowing compressed air into the ground with feeble cohesion or the cohesionless ground, the degree of saturation of the ground water in the said air-mixed zone is lowered down so that any liquefaction does not occur at the time of violent earthquake and the lowered degree of saturation of the ground water in the said air-mixed zone is kept semipermanently, liquefaction of the said zone of ground due to violent earthquake can be prevented without causing any such undesirable defect as land subsidence and the excellent effect can be achieved to save the structures founded on the air-mixed zone of ground from such a fatal damage as collapse or excessive tilting due to liquefaction caused by violent earthquake.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents which may be resorted to, fall within the scope of the present invention.

What is claimed is:

1. A method for preventing liquefaction of ground caused by violent earthquake comprising the steps of forming an air-mixed zone containing tiny air bubbles by blowing compressed air into the ground with feeble cohesion or the cohesionless ground by placing an air-tight cover on the ground surface covering the air-mixed zone containing tiny air bubbles and at the same time placing an air-tight cut-off wall extending down to the depth of ground water table along the outside periphery of said air-tight cover, penetrating pipes for blowing air through said air-tight cover into the ground to fill the pore space of the ground below said air-tight cover with air by blowing compressed air out from the tip portion of said pipes for blowing air, permitting air overfilled to leak out from outside of said cut-off wall, pushing down pipes for collecting air to penetrate into the ground in a simultaneous cycle of work with the pipes for blowing air being pushed down, exhausting collected air which is blown out from the pipes for blowing air up and out above the ground surface, pushing the pipes for blowing air and the pipes for collecting air further down to penetrate more deeply into the ground, the aforementioned process of blowing compressed air into the ground and collecting the air blown in is repeated until the improvement of the ground made over the entire range of predetermined depth is completed.

2. A system of an air supply-exhaust pipe to be used for preventing liquefaction of ground at the time of earthquake comprising an air supply pipe equipped with an air supply valve and connected to an air supply source and an air exhaust pipe equipped with an air exhaust valve connected to an air exhaust pipe, said air supply-exhaust pipe to be used both for blowing air and for collecting air, a water supply pipe inside said air supply-exhaust pipe equipped with a water supply valve connected to a high pressure water supply source to form a double tube composed of both of said pipes, said water supply pipe being connected to a first tube body equipped with a cutter blade for drilling ground and a water jet nozzle set-up inside, said air supply-exhaust pipe being connected detachably to the said first tube body as well as to a second tube body equipped with a strainer for blowing or collecting air.

3. The system of an air supply-exhaust pipe as defined in claim 2 to be used for preventing liquefaction of the ground at the time of earthquake, in the said first tube body including ring nozzle inlet holes provided for letting in the water jetted out from the water jet nozzle.

4. The system of an air supply-exhaust pipe as defined in claim 3 to be used for preventing liquefaction of the ground at the time of earthquake, said water jet nozzle discharging water in a ring shape, a guide block nearly conical in shape being held inside the first tube body with a narrow slit inside the first tube body, and a ring valve provided in said first tube body which is normally closed by fitting into a ring groove by the weight of the ring valve or by the pull down force of springs is activated to open by the upward pressure of water let in through the said water inlet holes.

* * * * *